US010921063B2

(12) United States Patent
Lin

(10) Patent No.: US 10,921,063 B2
(45) Date of Patent: Feb. 16, 2021

(54) HEAT DISSIPATION UNIT

(71) Applicant: ASIA VITAL COMPONENTS CO., LTD., New Taipei (TW)

(72) Inventor: Yu-Min Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 84 days.

(21) Appl. No.: 16/134,917

(22) Filed: Sep. 18, 2018

(65) Prior Publication Data

US 2020/0088472 A1 Mar. 19, 2020

(51) Int. Cl.
*F28F 7/00* (2006.01)
*F28D 15/04* (2006.01)

(52) U.S. Cl.
CPC ..... *F28D 15/046* (2013.01)

(58) Field of Classification Search
CPC .... F28F 21/086; F28F 2245/04; F28F 21/089; F28D 15/046; F28D 15/04; B21D 53/02
USPC ..... 165/80.4
See application file for complete search history.

(56) References Cited

U.S. PATENT DOCUMENTS 4,019,571 A * 4/1977 Kosson ..... F28D 15/046 165/104.26
6,749,013 B2 * 6/2004 Ikeda ..... H01L 23/427 165/104.26
2006/0096740 A1 * 5/2006 Zheng ..... F28D 15/0233 165/104.26
2007/0151710 A1 * 7/2007 Touzov ..... F28D 15/0233 165/104.26
2011/0146955 A1 * 6/2011 Chen ..... B22F 7/08 165/104.26
2013/0008634 A1 * 1/2013 Yang ..... F28D 15/0266 165/133

* cited by examiner

*Primary Examiner* — Davis D Hwu
(74) *Attorney, Agent, or Firm* — Bradley J. Thorson; DeWitt LLP

(57) ABSTRACT

A heat dissipation unit includes a main body and a mesh body. The main body has an upper plate and a lower plate. The upper and lower plates are correspondingly overlapped and mated with each other to together define an airtight chamber. A working fluid is contained in the airtight chamber. One face of the lower plate, which faces the airtight chamber, is formed with a capillary structure by means of laser processing. The mesh body is attached to the face of the lower plate with the capillary structure. By means of the mesh body, the liquid working fluid backflow efficiency of the capillary structure can be enhanced and the water content of the internal evaporation section of the heat dissipation unit can be increased to avoid dry burn.

3 Claims, 3 Drawing Sheets

HEAT DISSIPATION UNIT

BACKGROUND OF THE INVENTION

1. Field of the Invention

The present invention relates generally to a heat dissipation unit, and more particularly to a heat dissipation unit having various capillary structures for enhancing the liquid working fluid backflow efficiency and increasing the water content.

2. Description of the Related Art

A conventional vapor chamber or flat-plate heat pipe has a vacuumed airtight chamber. Capillary structures are disposed in the airtight chamber and a working fluid is contained in the airtight chamber to vapor-liquid circulate within the airtight chamber for transferring heat. The capillary structures can be sintered powders, mesh bodies, channeled bodies, fiber bodies or the like. The capillary structures serve to provide capillary attraction to absorb and make the working fluid flow back. Among the capillary structures, the porous capillary structure made of sintered powders is the most often used capillary structure and has best capillary attraction. However, due to the special structure or the manufacturing process, some of the vapor chambers or the flat-plate heat pipes cannot employ sintered powders or mesh bodies and fiber bodies as the capillary structures. Therefore, the wall face of the internal chamber of the vapor chamber or the flat-plate heat pipe is formed with channels as the capillary structures. The channeled structure is simpler than the other capillary structures. However, in the case that the vapor chamber or the flat-plate heat pipe is not horizontally placed, due to the factor of gravity, the working fluid contained therein can hardly flow back through the channels.

It is therefore tried by the applicant to provide a heat dissipation unit having various capillary structures for enhancing the liquid working fluid backflow efficiency and increasing the water content to solve the above problem.

SUMMARY OF THE INVENTION

It is therefore a primary object of the present invention to provide a heat dissipation unit, which has various capillary structures for enhancing the capillary attraction of the capillary structures.

To achieve the above and other objects, the heat dissipation unit of the present invention includes a main body and a mesh body.

The main body has an upper plate and a lower plate. The upper and lower plates are correspondingly overlapped and mated with each other to together define an airtight chamber. A working fluid is contained in the airtight chamber. One face of the lower plate, which faces the airtight chamber, is formed with a capillary structure by means of laser processing. The mesh body is attached to the face of the lower plate with the capillary structure.

By means of the mesh body, the capillary attraction of the capillary structure disposed on the lower plate is reinforced to enhance the liquid working fluid backflow efficiency of the capillary structure and increase the water content so as to enhance the vapor-liquid circulation efficiency inside the main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
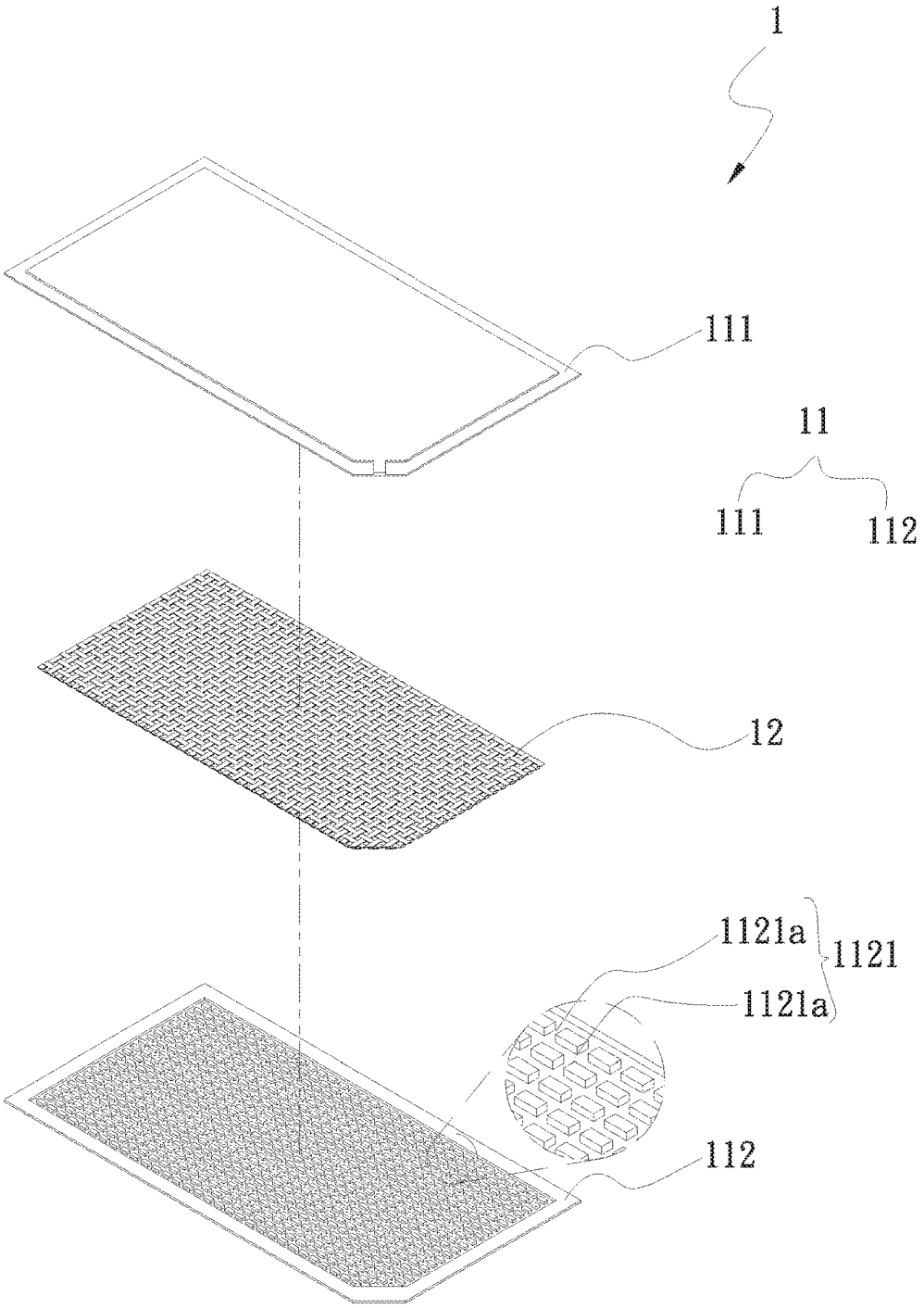
FIG. 1 is a perspective exploded view of a first embodiment of the heat dissipation unit of the present invention.
Figure 2:
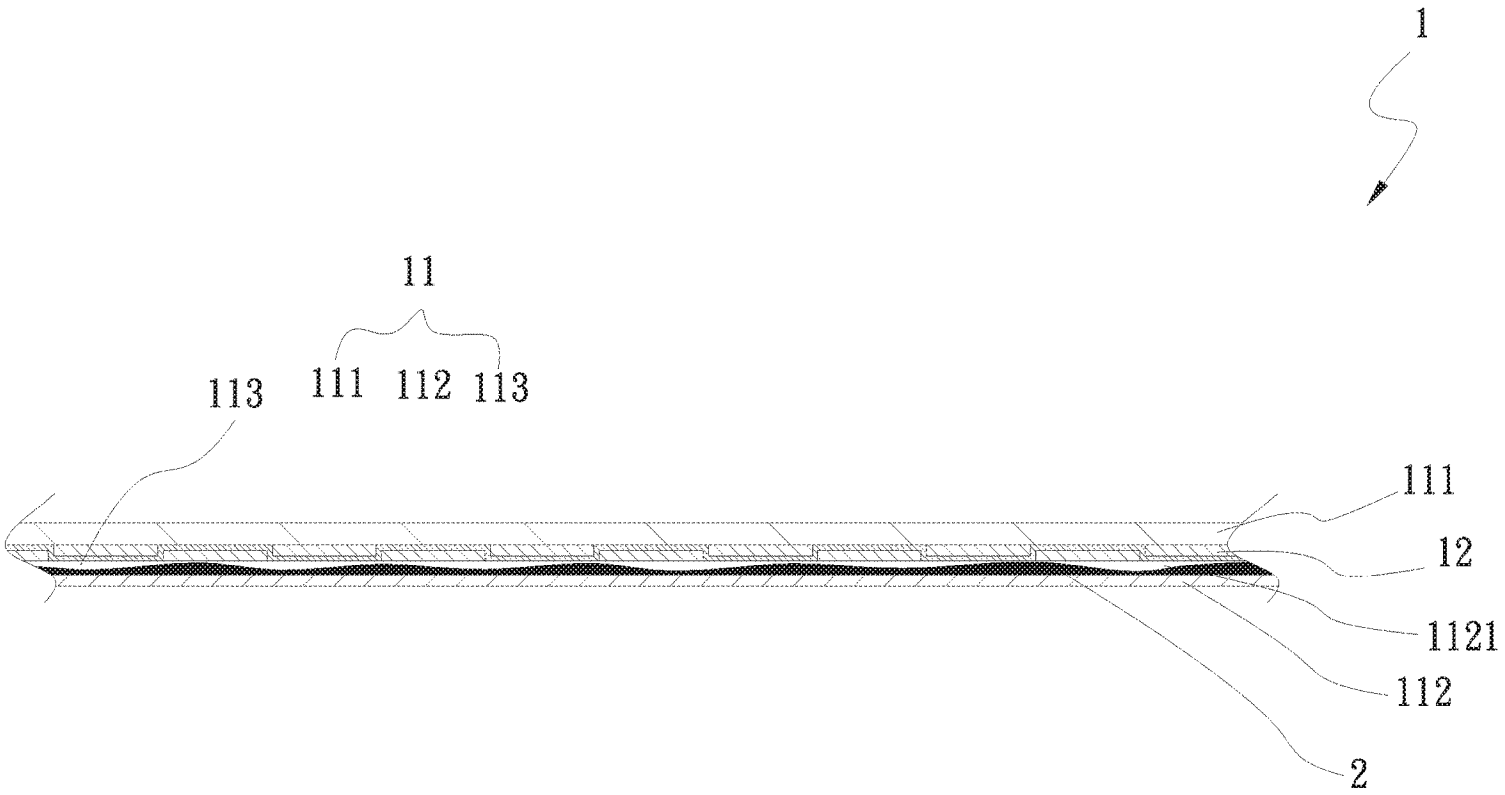
FIG. 2 is a sectional assembled view of the first embodiment of the heat dissipation unit of the present invention.

Please refer to FIGS. 1 and 2. FIG. 1 is a perspective exploded view of a first embodiment of the heat dissipation unit of the present invention. FIG. 2 is a sectional assembled view of the first embodiment of the heat dissipation unit of the present invention. As shown in the drawings, the heat dissipation unit 1 of the present invention includes a main body 11 and a mesh body 12.

The main body 11 has an upper plate 111 and a lower plate 112. The upper and lower plates 111, 112 are correspondingly overlapped and mated with each other to together define an airtight chamber 113. A working fluid 2 is contained in the airtight chamber 113. One face of the lower plate 112, which faces the airtight chamber 113, is formed with a capillary structure 1121 by means of laser processing. The upper and lower plate bodies 111, 112 are made of different materials or the same material selected from a group consisting of titanium, copper, aluminum, iron, fibers, plastics, titanium alloy, commercial pure titanium and ceramics. In this embodiment, the upper and lower plate bodies 111, 112 are, but not limited to, made of commercial pure titanium for illustration purposes. The capillary structure 1121 is composed of multiple channels 1121*a*. The channels 1121*a* extend in the horizontal transverse direction and longitudinal direction of the lower plate 112 to selectively intersect each other or not to intersect each other. In this embodiment, the channels 1121*a* intersect each other for illustration purposes.

The mesh body 12 is attached to the face of the lower plate 112 with the capillary structure 1121. The mesh body 12 is made of a material selected from a group consisting of titanium, copper, aluminum, iron, fibers, plastics, titanium alloy, commercial pure titanium and sintered powders. In this embodiment, the mesh body 12 is, but not limited to, made of commercial pure titanium for illustration purposes. The mesh body 12 is connected with the lower plate 112 by means of welding or diffusion bonding.

Figure 3:
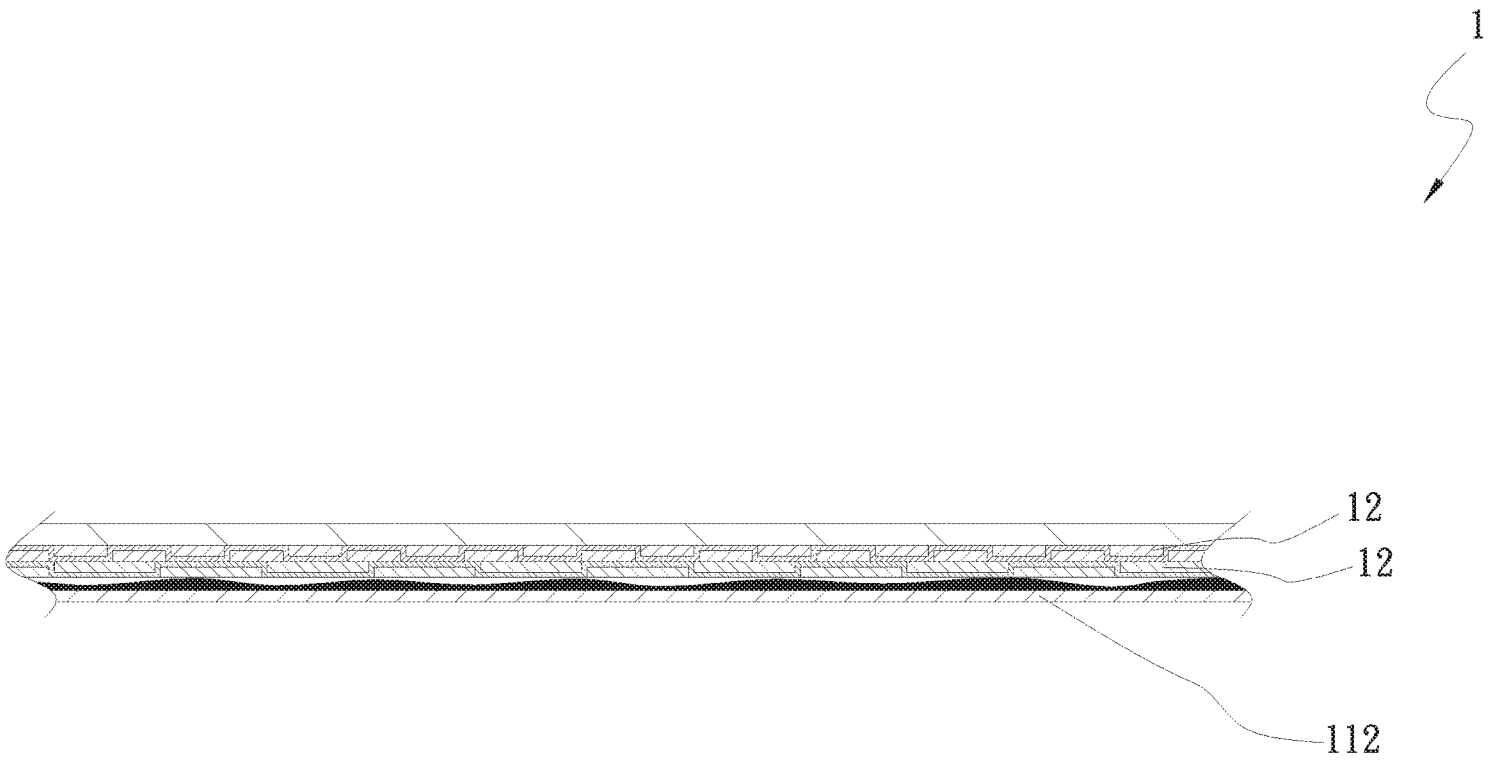
FIG. 3 is a sectional assembled view of a second embodiment of the heat dissipation unit of the present invention.

Please now refer to FIG. 3, which is a sectional assembled view of a second embodiment of the heat dissipation unit of the present invention. The second embodiment is partially identical to the first embodiment in structure and thus will not be redundantly described hereinafter. The second embodiment is different from the first embodiment in that there are multiple mesh bodies 12 overlapped with each other and securely connected with the lower plate 112. The mesh bodies 12 can be made of the same material or different materials in combination with each other. Alternatively, the mesh bodies 12 can have different weaving densities in combination with each other.

In the present invention, multiple layers of (capillary structure 1121 and mesh bodies 12) with capillary attraction are combined with each other to enhance the capillary attraction and increase the water content of the internal evaporation section of the heat dissipation unit so as to enhance the backflow efficiency of the liquid working fluid.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A heat dissipation unit comprising:

a main body having an upper plate and a lower plate, the upper and lower plates being correspondingly overlapped and mated with each other to together define an airtight chamber and made of a material selected from a group consisting of titanium, titanium alloy, commercial pure titanium and ceramics, a working fluid being contained in the airtight chamber, one face of the lower plate comprising a capillary structure, the capillary structure formed by means of laser processing and composed of multiple channels, the channels extending in a horizontal transverse direction and longitudinal direction of the lower plate; and a mesh body attached to the face of the lower plate or a multiple mesh bodies overlapped with each other and securely connected with the lower plate, the mesh body having a network with a plurality of meshes, the mesh bodies being made of the same material or different materials in combination with each other;

wherein the channels of the capillary structure having shapes that are different from those of the network of the mesh body.

2. The heat dissipation unit as claimed in claim 1, wherein the mesh body is made of a material selected from a group consisting of titanium, copper, aluminum, iron, fibers, plastics, titanium alloy, commercial pure titanium and sintered powders.

3. The heat dissipation unit as claimed in claim 1, wherein the mesh body is connected with the lower plate by means of welding or diffusion bonding.

* * * * *